US005527012A

United States Patent [19]

Vinkel et al.

[11] Patent Number: 5,527,012

[45] Date of Patent: Jun. 18, 1996

[54] FREEZING MOULD BAG, ESPECIALLY FOR FREEZING ICE LUMPS

[75] Inventors: Erik K. Vinkel, Abyhoej; Erling Vangedal-Nielsen, Vedbaek, both of Denmark

[73] Assignee: Schur Consumer Products A/S, Vejle, Denmark

[21] Appl. No.: 117,072

[22] PCT Filed: Mar. 3, 1992

[86] PCT No.: PCT/DK92/00065

§ 371 Date: Feb. 10, 1994

§ 102(e) Date: Feb. 10, 1994

[87] PCT Pub. No.: WO92/15491

PCT Pub. Date: Sep. 17, 1992

[30] Foreign Application Priority Data

| | | | |
|---|---|---|---|
| Mar. 5, 1991 | [DK] | Denmark | 0386/91 |
| Jul. 9, 1991 | [DK] | Denmark | 1329/91 |

[51] Int. Cl.[6] ..... B65D 30/22; B65D 33/16; F25C 1/24

[52] U.S. Cl. ..... 249/61; 249/110; 249/119; 249/127; 383/36; 383/38; 383/901; D15/90

[58] Field of Search ..... 249/61, 126, 127, 249/119, 110, 129; 383/44, 57, 36, 38, 39, 901; D9/305, 341; D15/90

[56] References Cited

U.S. PATENT DOCUMENTS

| | | | |
|---|---|---|---|
| Re. 31,890 | 5/1985 | Vangedal-Nielsen | 249/61 |
| 2,800,269 | 7/1957 | Smith | 229/62.5 |
| 3,189,252 | 6/1965 | Miller | 229/62.5 |
| 3,207,420 | 9/1965 | Navarrete-Kindelan | 229/56 |
| 3,263,903 | 8/1966 | Waller et al. | 229/62.5 |
| 3,282,412 | 11/1966 | Corella et al. | 206/47 |
| 3,306,567 | 2/1967 | Frei, Sr. | 249/126 |
| 3,313,472 | 4/1967 | Tjerneld et al. | 229/625 |
| 3,734,154 | 5/1973 | Polk | 383/57 |
| 3,806,025 | 4/1974 | Marshall | 229/62.5 |
| 4,181,285 | 1/1980 | Vangedal-Nielsen | 249/110 |
| 4,416,308 | 11/1983 | Bower | 383/57 |
| 4,478,386 | 10/1984 | Mikkelsen | 249/61 |
| 4,723,944 | 2/1988 | Jensen | 604/323 |
| 4,758,099 | 7/1988 | Branson | 383/57 |
| 4,783,042 | 11/1988 | Folkmar | 249/127 |
| 4,813,646 | 3/1989 | Fujio | 249/61 |
| 4,822,180 | 4/1989 | Gjelstrup et al. | 383/57 |

FOREIGN PATENT DOCUMENTS

| | | |
|---|---|---|
| 0129072 | 12/1984 | European Pat. Off. . |
| 129072 | 12/1984 | European Pat. Off. . |
| 0264407B1 | 4/1991 | European Pat. Off. . |
| 890513 | 2/1989 | Finland . |
| 855804 | 12/1960 | United Kingdom . |
| 1190861 | 4/1965 | United Kingdom . |
| 1001872 | 8/1965 | United Kingdom . |
| 2074983 | 11/1981 | United Kingdom . |
| WO82/0279 | 2/1982 | WIPO . |
| WO86/4561 | 8/1986 | WIPO . |
| WO87/1183 | 2/1987 | WIPO . |
| WO90/8525 | 8/1990 | WIPO . |
| 91/08951 | 6/1991 | WIPO . |

*Primary Examiner*—James P. Mackey
*Attorney, Agent, or Firm*—Keck, Mahin & Cate

[57] ABSTRACT

A freezing mould bag for ices is formed from two plastic foils, and has a segmented inlet channel, two closure valve flaps extending within the interior of the bag, and a constriction which provides a venturi effect closing the bag at the constriction.

45 Claims, 2 Drawing Sheets

FREEZING MOULD BAG, ESPECIALLY FOR FREEZING ICE LUMPS

BACKGROUND OF THE INVENTION

The present invention relates to a freezing mould bag, especially for freezing ice lumps or ice cubes, and more precisely a freezing mould bag providing a self-closing effect.

Numerous freezing mould bags are known within the art, e.g. from U.S. Pat. No. 3,207,420, Re-issued U.S. Pat. No. 31,890, U.S. Pat. No. 4,822,180, corresponding to European Patent No. 0 264 407, European Patent Application No. 0 129 072, International Patent Application, Publication No. WO82/00279, International Patent Application, Publication No. WO87/01183, and International Patent Application, Publication No. WO86/04561, to which Patents and Patent Applications reference is made, and which U.S. Patents are herewith incorporated in the present specification by reference.

In the above-mentioned re-issued U.S. Pat. No. Re 31,890, a freezing mould bag is described and disclosed, vide FIG. 7 and the corresponding part of the specification, comprising two closing flaps providing a check valve of a self-closing freezing mould bag.

European Patent No. 0 264 407 also discloses a freezing mould bag which according to the specification of the European Patent is adapted to provide a self-closing function. The freezing mould bag according to the European Patent comprises two closure flaps defining closure pockets of the freezing mould bag and is stated to seal the interior of the freezing mould bag and to prevent that liquid or water leaks from the interior of the freezing mould bag, provided the interior of the freezing mould bag is filled with liquid, preferably water, intended to be frozen to ice lumps or ice cubes.

In the specification of the above-mentioned European Patent No. 0 264 407 it is specifically explained how the self-closing function is established as the freezing mould bag is initially completely evacuated prior to the stage of filling the freezing mould bag with liquid or water to be frozen within the freezing mould bag, and as the filling of the freezing mould bag results in a complete filling of the closure pockets of the freezing mould bag. The complete filling of the closure pockets of the freezing mould bag further results in that the closure flaps of the freezing mould bag are pressed against one another in consequence of tensioning of the foils of the freezing mould bag, which tensioning is established in specific weld seams providing a constriction of an inlet channel of the freezing mould bag, which inlet channel is of a configuration basically tapering from an inlet opening of the freezing mould bag towards the interior of the freezing mould bag. Thus, the complete filling of the interior of the freezing mould bag is consequently based on a completely evacuated state of the interior of the freezing mould bag prior to the filling of the interior of the freezing mould bag and a complete filling of the interior of the freezing mould bag, and specifically a complete filling of the closure pockets of the freezing mould bag.

Alternatively, the complete filling of the interior of the freezing mould bag according to the above-mentioned European Patent No. 0 264 407 is believed to be based on the following relations, although the European Patent is completely mute regarding these relations. It is believed that the closure pockets may be vented through venting channels provided between the upper turned-in edge of the freezing mould bag and the circumferential weld seam which according to the drawing of the European Patent is provided at a small distance below the upper turned-in edge of the freezing mould bag.

The self-closing function of the freezing mould bag according to the above-mentioned European Patent No. 0 264 407 is, as explained in the European Patent, dependent on a complete filling of the closure pockets, which complete filling is further dependent on, in the first place, a completely evacuated state of the interior of the freezing mould bag prior to initiating the filling of the freezing mould bag, or, in the second place, dependent on a venting of the closure pockets through the above described venting channels, as the self-closing function is established by filling the closure pockets with liquid or water and by generating a compression of the closure flaps of the freezing mould bag for closing the freezing mould bag. The freezing mould bag according to the European Patent is not adapted to and not intended to generate a self-closing function unless the interior of the freezing mould bag, and specifically the closure pockets of the freezing mould bag, are completely filled with liquid, especially water to be frozen to ice lumps or ice cubes.

The freezing mould bag according to the above-mentioned European Patent No. 0 264 407 consequently suffers from a serious drawback in that the freezing mould bag, provided the freezing mould bag is not completely filled with liquid or water resulting in that the closure pockets are not completely filled with liquid or water, is not able to provide a reliable self-closing function, i.e. generate a complete closing of the inlet channel, and consequently prevent that liquid or water leaks from the interior of the freezing mould bag through the inlet channel as air may to some extent inflate the interior of the freezing mould bag prior to the filling of the interior of the freezing mould bag with liquid or water or during the filling of the interior of the frezing mould bag with liquid or water, and as the air is not vented to the environment through the above-mentioned channels. The incomplete and unreliable self-closing function may result in a partial emptying of liquid or water from the interior of the freezing mould bag and further result in annoyance of the consumer, as the consumer may have to wipe off spilt liquid or water. The incomplete and unreliable self-closing function of the freezing mould bag also results in that ice lumps or ice cubes smaller than the optimum or maximum size are generated, resulting in a less efficient utilization of the freezing mould bag for its intentional purpose, i.e. the freezing of ice lumps or ice cubes.

European Patent Application No. 0 129 072 further describes a freezing mould bag which according to the specification of the European Patent Application is adapted to generate a far more elaborated self-closing function as compared to the function of the freezing mould bag according to the above-mentioned European Patent No. 0 264 407. Thus, it is stated that a self-closing function is established even though the closure pockets are not completely filled with liquid or water, as the freezing mould bag according to She above-mentioned European Patent Application No. 0 129 072 is stated to be adapted to provide a self-closing function independent of a complete or partial filling out of the interior of the freezing mould bag with liquid or water. The self-closing function of the freezing mould bag according to the above-mentioned European Patent Application No. 0 129 072 is stated to be provided by means of a narrow, tubular inlet arranged within an inlet channel of the freezing mould bag and extending from the interior of the freezing mould bag through the inlet channel to a position approximately half-way along the inlet channel along the longitudinal direction of the inlet channel, in which position the tubular inlet is connected to two sheets of the freezing mould bag defining two closure pockets.

The freezing mould bag according to the above-mentioned European Patent Application No. 0 129 072, however, has proven not to function absolutely satisfactorily as the freezing mould bag does not provide a safe and reliable self-closing function, i.e. the freezing mould bag does not guarantee that there is every probability that the freezing mould bag is closing as the freezing mould bag is turned upside down for generating a self-closing function after a complete or partial filling of the interior of the freezing mould bag with liquid or water. This lack of reliability is believed to be based on the following relations. The closure pockets are, on the one hand, in consequence of the small size of the closure pockets unable to generate a pressure capable of closing the inlet channel of the freezing mould bag. The structure of the freezing mould bag according to the above-mentioned European Patent Application No. 0 129 072 is, on the other hand, not deduced, taking into due consideration the hydrodynamic and hydraulic relations which, as will be explained below with reference to the detailed discussion of the realization on which the present invention is based, may be utilized for creating a safe and reliable self-closing function, i.e. a self-closing function which, as the self-closing mould bag is completely or partially filled with liquid or water, and as the freezing mould bag is turned upside down, provides a substantially fail-safe closing of the interior of the freezing mould bag independent of whether or not the closure pockets are filled with liquid or air at the time the self-closing freezing mould bag is turned upside down.

SUMMARY OF THE INVENTION

An object of the present invention is to provide a freezing mould bag which in a safe and reliable manner is capable of generating a self-closing effect as the freezing mould bag is turned upside down, i.e. turned from a position in which an inlet opening of the freezing mould bag is facing upwardly to a position in which the inlet opening is facing downwardly, independent of whether or not the interior of the freezing mould bag is filled completely or partially with liquid or water so as to guarantee that the liquid or water contained within the interior of the freezing mould bag is confined within the interior of the freezing mould bag and so as to limit the amount of liquid or water which is spilt from the freezing mould bag as the freezing mould bag after filling is turned upside down to substantially no more than an amount of liquid or water confined within a section or segment of an inlet channel of the freezing mould bag and to prevent that liquid or water not-confined within the interior of the freezing mould bag is spilt.

The above object, numerous other objects, features and advantages which are readily understood by a person having ordinary skill in the art from the below detailed description of the present invention are obtained by a freezing mould bag according to the present invention comprising:

two sheets of a foil material, said sheets being of substantially identical geometrical shape and defining an outer periphery, a peripheral joint extending along the majority of said outer periphery of said sheets, except for a peripheral area constituting an inlet opening of said bag, said peripheral joint joining said sheets together in substantially overlapping relationship and defining an inner space within the interior of said bag, said inner space constituting at least one mould compartment, and preferably a plurality of mould compartments being interconnected and being defined by separate joints of said sheets, an inlet channel defined by separate joints of said sheets and extending from said inner space of said bag to said inlet opening so as to provide access from the environment to said inner space of said bag through said inlet channel, two closure valve flaps connected to said sheets at said inlet opening and extending from said inlet opening within the interior of said bag towards said inner space of said bag along said inlet channel, said closure valve flaps being joined together and being joined to said sheets through said separate joints defining said inlet channel so as to provide two closure pockets being open towards said inner space of said bag, said inlet channel comprising a first segment and a second segment, said first segment being provided adjacent to said inlet opening, and said second segment interconnecting said first segment and said mould compartment or mould compartments, said first segment tapering towards said second segment, said first segment and said second segment defining at their transition a constriction, said second segment having dimensions so as to no substantial extent hinder the transfer of liquid through said second segment, and said constriction at said transition providing a venturi effect for generating a pressure drop at said constriction for closing said inlet channel at said constriction as liquid is flowing from said second segment towards said first segment through said constriction so as to generate a self-closing effect.

The present invention is based on the following realization. The interior of a freezing mould bag may be filled with liquid or water until the liquid or water has reached such a height within the interior of the freezing mould bag as any air confined within the interior of the freezing mould bag allows. When the freezing mould bag is turned upside down after filling, which may comprise a complete or partial filling of the interior of the freezing mould bag, in which last instance an amount of air is confined within the closure pockets of the freezing mould bag, the liquid or water confined within the first and second segment of the inlet channel flows out through the inlet channel of the freezing mould bag, whereby a relative pressure drop is generated within the constriction defined between the first and the second segment of the inlet channel by the venturi effect, which pressure drop causes the closure valve flaps to be pressed against one another, resulting in that the liquid or water flowing within the interior of the freezing mould bag flows into the closure pockets and fills out the closure pockets generating a final closing of the interior of the freezing mould bag.

According to the teaching of the present invention, it is mandatory that a segment of the inlet channel is provided behind the constriction which segment has dimensions so as to allow that the liquid or water may flow through said segment without, to any substantial extent, hinder the transfer of liquid through said segment in order to obtain a maximum flow rate through the constriction further in order to obtain a maximum pressure drop within the constriction through the venturi effect and, consequently, in order to generate a closing of the inlet channel as fast as possible through the generation of the highest possible pressure, and consequently the highest possible force impact to the closure valve flaps towards one another.

It is to be realized that the freezing mould bag known from the above-mentioned European Patent No. 0 264 407 is not able to generate a venturi effect for generating a relative pressure drop within the constriction of the freezing mould bag, which constriction is provided by additional weld seams in case it is attempted to use the freezing mould bag of the European patent in contradiction to the technical disclosure of the European patent, however, in accordance with the realization on which the present invention is based, as the inlet channel tapers towards the interior of the freezing mould bag within the constriction defined by the additional weld seams, resulting in that the segment of the inlet channel of the freezing mould bag of the European patent, which segment as defined within the constriction of the inlet channel does not fulfil the requirement that the segment must have dimensions so as to to no substantial extent hinder the transfer of liquid through the segment.

Within the inlet channel of the freezing mould bag according to the above-mentioned European Patent No. 0 264 407, a joint is further provided, joining the sheets of the freezing mould bag together, which joint is shown in the drawing and is further described fulfilling the purpose of reducing the flow rate of the liquid or water flowing into the interior of the freezing mould bag during the operation of filling the freezing mould bag. The above-mentioned joint obviously, in case the freezing mould bag according to the European Patent No. 0 264 407 is used in accordance with the teachings of the present invention so as to generate a closing of the inlet channel through venturi effect, obviously hinders the flowing or transfer of liquid or water from the interior of the freezing mould bag, resulting in that a reduced flow rate of the liquid or water flowing through the inlet channel through the constriction thereof is generated, further resulting in that a small relative pressure drop is generated at the constriction defined by the above-mentioned additional weld seams, which relatively small pressure drop is not able to generate a swift and reliable self-closing of the inlet channel, and consequently of the freezing mould bag.

The above described freezing mould bag known from the above-mentioned European Patent Application No. 0 129 072, which freezing mould bag is stated to be of a more elaborated structure than the freezing mould bag according to the above-mentioned European Patent No. 0 264 407, is not capable of generating a closing of the inlet channel through venturi effect in consequence of the reduced flow area of the narrow, tubular inlet arranged within the inlet channel of the freezing mould bag as indicated above.

The closure valve flaps of the freezing mould bag according to the present invention may be constituted by separate flap components which may be made from the same material as the sheets of the freezing mould bag or a different material of increased or reduced flexibility in order to obtain the venturi effect, characteristic of the present invention. In accordance with the presently preferred embodiment of the freezing mould bag according to the present invention, the closure valve flaps are constituted by turned-in parts of the sheets. According to the preferred embodiment of the freezing mould bag according to the present invention, the closure valve flaps are consequently constituted by integral components or parts of the sheets of the freezing mould bag. In case the closure valve flaps are constituted by separate components or parts, the closure valve flaps may be fastened to the sheets through joints which may be established through glueing or welding, dependent on the specific materials of the sheets and the closure valve flaps of the freezing mould bag.

The closure pockets of the freezing mould bag according to the above-mentioned European Patent No. 0 264 407 are of a configuration defining substantially spherical or conical contact surfaces between the two closure pockets. Consequently, the closure pockets are in a single point or single line contact providing an inadequate closing of the interior of the freezing mould bag, resulting in that liquid or water may leak along the weld seams defining the inlet channel of the freezing mould bag. In order to provide a more reliable and more efficient sealing of the interior of the freezing mould bag according to the present invention, the second segment preferably expands from the constriction at the transition substantially along a direction perpendicular to the longitudinal direction of the inlet channel, which longitudinal direction defines a first direction, and which direction perpendicular to the longitudinal direction or the first direction constitutes a second direction. The above configuration of the second segment of the inlet channel of the freezing bag according to the present invention defines cylindrical surfaces of the closure pockets as the closure pockets are distended with liquid or water, which cylindrical surfaces provide an increased contact surface area as compared to the spherical or conical surfaces of the closure pockets of the freezing mould bag according to the above-mentioned European Patent No. 0 264 407, and consequently an increased closing pressure and a more reliable and efficient sealing.

In accordance with the teachings of the present invention, it is mandatory that a relative pressure drop be generated within the constriction defined at the transition between the first and the second segment of the inlet channel, as the liquid or the water is flowing from the second segment to the first segment for generating a venturi effect within the constriction. In order to obtain a safe and reliable filling of the closure pockets, as the closure valve flaps are pressed against one another through the venturi effect, characteristic of the present invention, it is in accordance with the presently preferred embodiment of the freezing mould bag according to the present invention preferred that the closure valve flaps extend from the inlet opening beyond the constriction at the transition between the first and the second segment of the inlet channel to a position approximately at the centre of the second segment.

In accordance with alternative embodiments of the freezing mould bag according to the present invention, the closure valve flaps extend from the inlet opening beyond the constriction at the transition between the first and the second segment of the inlet channel to a position adjacent to the constriction, or alternatively extend from the inlet opening beyond the constriction at the transition between the first and the second segment of the inlet channel, substantially along the entire inlet channel, and consequently to the inner boundary of the second segment of the inlet channel. The length of the valve closure flaps is, as will be readily understood by a person having ordinary skill in the art, of importance, firstly as to the amount of liquid or water which is spilt as the freezing mould bag is turned upside down after the filling of the interior of the freezing mould bag with liquid or water, as a part of the amount of water or liquid which is contained within the inlet channel is expelled as the freezing mould bag is turned upside down, and secondly as to the flowing of the liquid or water from the interior of the freezing mould bag into the closure pockets. Experiments have revealed that closure valve flaps implemented in accordance with the above described, presently preferred embodiment of the freezing mould bag according to the present invention, fulfil the requirements as to, on the one hand, the spilling of a minimum amount of water or liquid and, on the other hand, a swift and efficient closing of the inlet channel by pressing the closure valve flaps together and a subsequent swift and efficient filling of the closure pockets.

In order to obtain an efficient self-closing of the freezing mould bag according to the present invention, the closure valve flaps preferably extend to a position defining a distance from the constriction at the transition between the first and the second segment of the inlet channel being at least 0.5 times the dimension of the constriction along the second direction, i.e. along the direction perpendicular to the longitudinal direction of the inlet channel, preferably 0.5–2 times the dimension of the constriction.

The feature, characteristic of the present invention, regarding the dimensions of the second segment of the inlet channel providing an unhindered flow or transfer of liquid or water through the second segment is, in accordance with the presently preferred embodiment of the freezing mould bag according to the present invention, fulfilled, provided the second segment of the inlet channel has a maximum dimension along the second direction of the inlet channel being at least 1.6 times the dimension of the constriction along the second direction, preferably 2–7 times the dimension of the constriction, further preferably 2.4–5 times the dimension of the constriction, such as 2.6–3.4 times the dimension of the constriction.

In order to guarantee that the first segment of the inlet channel to no substantial extent hinders the flow of liquid or transfer of liquid through the first segment of the inlet channel and consequently reduces the venturi effect generated at the constriction at the transition between the first and the second segment of the inlet channel and consequently reduces the relative pressure drop within the constriction, resulting in a reduced closing effect generated by a reduced venturi effect, the first segment of the inlet channel preferably in accordance with the presently preferred embodiment of the freezing mould bag according to the present invention has a dimension, along the second direction of the inlet channel, i.e. perpendicular to the longitudinal direction of the inlet channel, at the inlet opening being approximately two times the dimension of the constriction along the second direction.

Similarly, the dimensions of the first and the second segment of the inlet channel along the first direction of the inlet channel are of importance as to the expansion of the first segment from the constriction towards the inlet opening for generating the venturi effect within the constriction. Preferred and advantageous dimensions of the parts and components of the freezing mould bag are discussed in the below detailed description of the presently preferred embodiment of the freezing mould bag according to the present invention and the below Example.

The first segment of the inlet channel tapering from the inlet opening towards the interior of the freezing mould bag may be bounded by joints of any appropriate configuration, taking into consideration the generation of the venturi effect within the constriction. The first segment of the inlet channel may, consequently, be bounded by joints constituting straight lines or curved lines defining a first segment of a convex or concave configuration. However, the joints defining the first segment are preferably constituted by straight lines or curved lines defining a first segment of a basically concave configuration.

The second segment of the inlet channel may be bounded by joints of any appropriate configuration, taking into consideration the fulfilling of the requirement as to to no substantial extent hinder the transfer of liquid through the second segment, and further taking into consideration the generation of the venturi effect within the constriction. The second segment of the inlet channel may, consequently, be bounded by joints constituting straight lines or curved lines, however, preferably constituting partly straight lines and partly curved lines, such as segments of circles defining a second segment of a convex or concave configuration, preferably a second segment of a concave configuration.

The inlet channel comprising the first and the second segment may, fulfilling the above described requirements, be of an unsymmetrical configuration and further be of an overall curved configuration. However, in accordance with the presently preferred embodiment of the freezing mould bag according to the present invention, the inlet channel is substantially symmetrical relative to its longitudinal axis.

According to the presently preferred embodiment of the freezing mould bag according to the present invention, the freezing mould bag comprises a plurality of mould compartments, preferably more than two mould compartments, further preferably more than twelve mould compartments, such as eighteen or twenty-four mould compartments.

The feature, characteristic of the present invention and discussed above regarding the dimensions of the second segment of the inlet channel, is in accordance with the teaching of the present invention and in accordance with the presently preferred embodiment of the freezing mould bag according to the present invention fulfilled, provided the second segment has a size corresponding to approximately 1–2 times a single mould compartment, preferably 2 times a single mould compartment.

The configuration of the second segment having dimensions so as to provide the second segment having a size larger than the size of a single mould compartment further serves the purpose of informing the consumer that the second segment is different from mould compartments in which ice lumps or ice cubes are contained, as the ice lump or ice cube which is made from the liquid or water confined within the second segment of the inlet channel contains segments of the closure valve flaps frozen within the liquid or water, which segments are later on liberated, as the ice lump or ice cube is thawed.

The sheets of foil material from which the freezing mould bag is composed or made, and from which the closure valve flaps in accordance with the presently preferred embodiment of the freezing mould bag according to the present invention are made from turned-in parts of the sheets, are preferably manufactured by cutting segments of continuous paths of foil material as will be well-known within the art. The sheets of foil material may further constitute segments of planar foil paths or segments of foil paths provided with printings corresponding to the mould compartments of the freezing mould bag. Prior to the operation of cutting the two segments constituting the two sheets of the freezing mould bag according to the present invention from a single continuous foil path or from two continuous foil paths, which segments are subsequently to be joined together for creating the freezing mould bag according to the present invention, one of the continuous foil paths, in case a single continuous foil path is used, from which both segments are cut or punched, or in case only one of the segments is provided with printings, or alternatively both continuous foil paths in case two continuous foil paths are employed for providing two segments to be joined together constituting the freezing mould bag according to the present invention, is or are brought into contact with one or more printing tools, such as a punching tool or a heat-printing tool, e.g. a heated printing dye for generating the above-mentioned printings corresponding to the mould compartments of the freezing mould bag. The generation of printings of the sheets of the freezing mould bag or of one of the sheets of the freezing mould bag, in case the freezing mould bag is not of a symmetrical configuration, may serve the purpose of allowing an increased filling of the interior of the freezing mould bag and consequently provide larger ice lumps or ice cubes within the same dimensions of the freezing mould bag as compared to a freezing mould bag, the sheets of which are not provided with printings corresponding to the mould compartments of the freezing mould bag.

The sheets from which the freezing mould bag is produced may be constituted by plastic foil sheets or aluminum foil sheets, and the joints may be constituted by welded joints or glue joints. The sheets may further be constituted by laminates of e.g. plastics material and metal foil or plastic foils to which a metal coating is applied in an evaporation process. The choice of foil material and the choice of the thickness of the foil material or foil materials firstly depends on the consideration regarding, on the one hand, the provision of a hermetically sealed freezing mould bag, i.e. a freezing mould bag which does not leak unintentionally and, on the other hand, the provision of a freezing mould bag which after the operation of freezing the liquid or water to e.g. ice lumps or ice cubes is easily openable by cutting or tearing the sheets apart, and secondly depends on the provision of an efficient self-closing effect, i.e. taking into consideration partly the provision of the venturi effect, characteristic of the present invention, at the constriction defined at the transistion between the first and the second segment of the inlet channel, and partly a reliable permanent closing of the interior of the freezing mould bag by pressing the closure valve flaps together, resulting from a complete distension of the closure pockets with liquid or water.

BRIEF DESCRIPTION OF THE DRAWING

The invention will now be further described with reference to the drawings, in which.

DESCRIPTION OF THE PREFERRED EMBODIMENT

Figure 1:
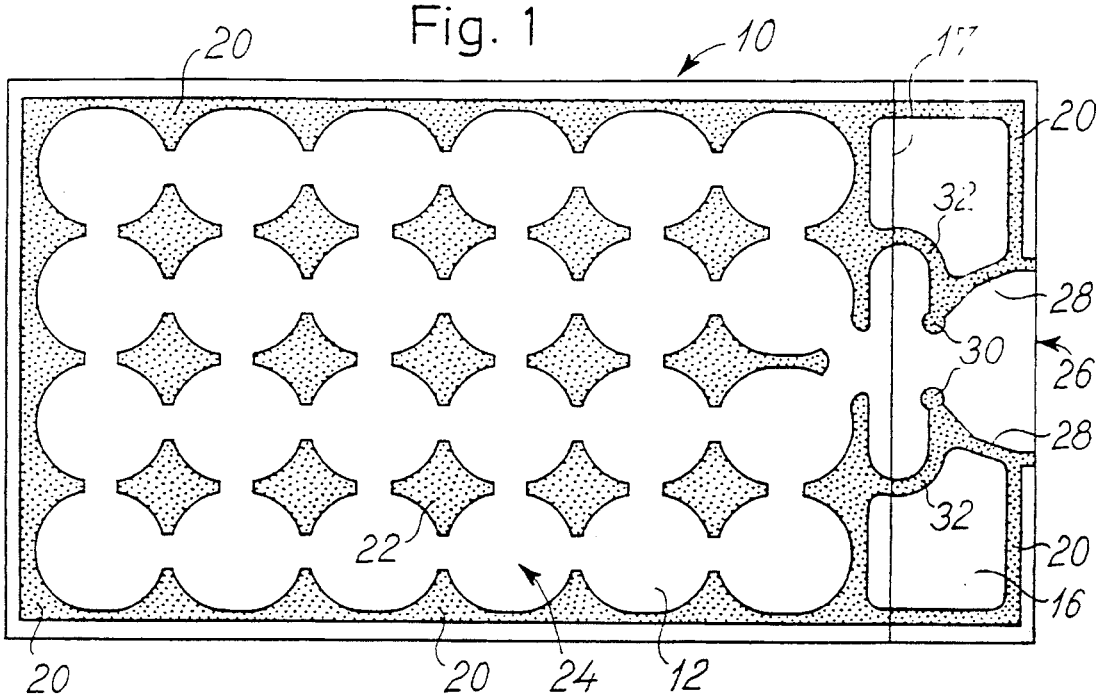
FIG. 1 is a schematical view of a presently preferred embodiment of the freezing mould bag according to the present invention.
Figure 2:
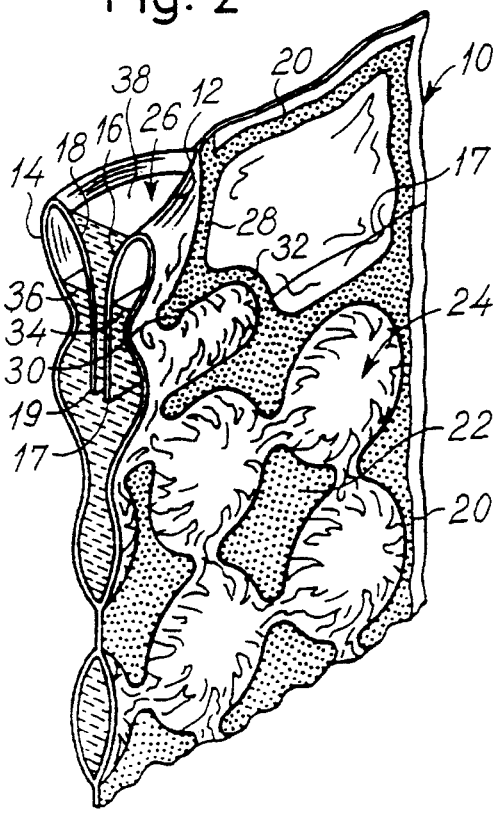
FIGS. 2 and 3 are schematic, sectional and perspective views of the presently preferred embodiment of the freezing mould bag according to the present invention, illustrating the freezing mould bag in a completely filled state having the inlet channel facing upwardly and having the inlet channel facing downwardly, respectively, illustrating the venturi effect, characteristic of the present invention.
Figure 3:
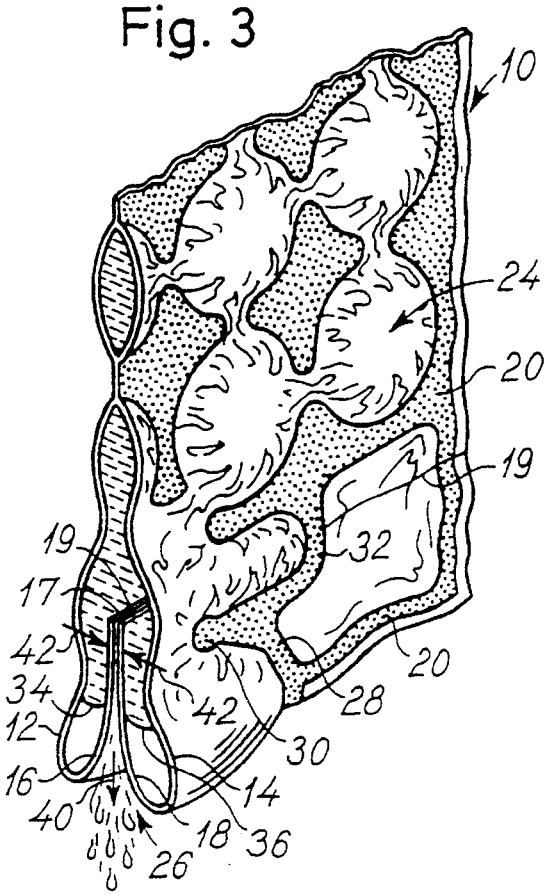

In FIG. 1, a first, presently preferred embodiment of a freezing mould bag according to the present invention is shown in a plane and schematical view. The freezing mould bag is in its entirety designated the reference numeral 10. The freezing mould bag 10 is, as will be evident from the perspective and sectional views of FIGS. 2 and 3, illustrating the interior of the freezing mould bag composed of two identical plastic sheets, preferably sheets of LD polyethylene foil of a thickness of 25 μm, or alternatively HD polyethylene foil of a thickness of 18 μm, the sheets being designated the reference numerals 12 and 14. Each of the sheets 12 and 14 comprises a turned-in part designated the reference numerals 16 and 18, which turned-in parts extend within the interior of the freezing mould bag 10 defining inner edges 17 and 19, respectively. The sheets 12 and 14 are of a substantially rectangular configuration and are arranged in an overlapping juxtaposed relationship in which the above-mentioned turned-in parts 16 and 18 extend into the interior of the freezing mould bag 10, as the sheets 12 and 14 are joined together through partly a peripheral joint 20 extending along the periphery of the sheets 12 and 14, except for an area to be described below, and partly octagonal, discretely arranged joints 22 which together, and together with the peripheral joint 20, define a total of 24 individual mould compartments, one of which is designated the reference numeral 24.

At a central area of the edge of the freezing mould bag 10, which edge is defined by the turned-in parts 16 and 18 of the sheets 12 and 14, respectively, the circumferential joint 20 is interrupted as the sheets 12 and 14 are not joined together at this area so as to provide an inlet opening at said area, which inlet opening constitutes an inlet opening of an inlet channel extending from the environment to the interior of the freezing mould bag 10. Said area defining the inlet opening of the inlet channel is designated the reference numeral 26. From the above-mentioned edge, mutually convergent joints 28 extend towards the interior of the freezing mould bag 10, which joints 28 terminate in circularly configurated reinforcing joints 30. The mutually convergent joints 28 define a first segment of the inlet channel of the freezing mould bag 10 beyond which first segment mutually divergent joints 32 define a second segment of the inlet channel, which second segment has dimensions in a direction perpendicular to the inlet direction or the longitudinal direction of the inlet channel far larger than the corresponding dimensions of the first segment of the inlet channel. The above-mentioned circular reinforcing joints 30 define a constriction at the conjunction or the transition between the first and the second segment of the inlet channel, which constriction serves a specific purpose in accordance with the teachings of the present invention, as will be described in greater detail below.

In FIG. 1, the two sheets 12 and 14 of the freezing mould bag are arranged in a substantial planar juxtaposed position as the interior of the freezing mould bag may be partially filled with air defining air pockets within the interior of the freezing mould bag. In FIG. 1, the freezing mould bag 10 is shown having its inlet opening 26 facing to the right, which inlet opening 26, as is evident from FIG. 2, is facing upwardly as the freezing mould bag is being filled with liquid, preferably or specifically water to be frozen to ice lumps or ice cubes. In the present context, expressions such as upwardly, downwardly, upper, lower, etc. refer to an orientation of the freezing mould bag in relation to the vertical direction defined by the gravitational force, which expressions are merely to be understood describing the normal overall orientation of the freezing mould bag when in use as, of course, a larger or minor part of the freezing mould bag may be folded relative to a specific direction such as the vertical direction and as the freezing mould bag in its entirety may be kept in a sloping orientation relative to a specific direction such as the vertical direction.

FIG. 2 is a sectional view of an upper part of the freezing mould bag 10 disclosing the freezing mould bag 10 after the completion of the operation in which the interior of the freezing mould bag is filled with liquid, preferably or specifically water to be frozen to ice lumps or ice cubes, through the inlet opening 26 which is facing upwardly.

As is evident from FIG. 2, the liquid or water fills out the mould compartments 24 which are distended by the water pressure and further fills out the second segment of the inlet channel. By the filling out of the mould compartments 24 and further the filling out of the second segment of the inlet channel defined by the joints 32, the sheets 12 and 14 are distended relative to one another by which distension the turned-in parts 16 and 18 of the sheets 12 and 14 are separated from one another resulting in a separation of the lower edges 17 and 19 of the turned-in parts 16 and 18, respectively, of the sheets 12 and 14. The liquid or water filling out the interior of the freezing mould bag 10 rises within the interior of the freezing mould bag on both sides of the turned-in parts 16 and 18 of the sheets 12 and 14, respectively, as the liquid or water rises within the cavities constituting closure pockets defined between the turned-in parts 16 and 18 of the sheets 12 and 14 and the sheets 12 and 14, respectively, to a specific height determined by the amount of air confined within the cavities or closure pockets. The surfaces of liquid or water rising within the closure pockets are designated the reference numerals 34 and 36. Between the turned-in parts 16 and 18 within the inlet channel, the liquid or water rises to a height corresponding to the upper edge of the inlet opening 26. The surface of the liquid or water present between the turned-in parts 16 and 18 within the first segment of the inlet channel is designated the reference numeral 38. As is evident from FIG. 2, the turned-in parts 16 and 18 of the sheets 12 and 14, respectively, define a basically tapering inlet, guiding the liquid or water into the interior of the freezing mould bag 10. The turned-in parts 16 and 18 further serve the purpose of providing closure valve flaps which seal the interior of the freezing mould bag relative to the environment, as the turned-in parts 16 and 18 of the sheets 12 and 14, respectively, are pressed against one another within the inlet channel. As is evident from FIG. 2, the closing or sealing of the interior of the freezing mould bag 10 is not established at the time at which the liquid or water has been filled into the interior of the freezing mould bag 10 as the air pockets above the liquid or water surfaces 34 and 36 within the closure pockets defined between the sheets 12 and 14 and the corresponding turned-in parts 16 and 18, respectively, thereof, and the presence of liquid or water between the turned-in parts 16 and 18 of the foils 12 and 14, respectively, precludes the generation of a water pressure within the cavities, which water pressure is capable of pressing the closure valve flaps generated by the turned-in parts 16 and 18 against one another.

As the freezing mould bag 10 is turned upside down from its position shown in FIG. 2 to its position shown in FIG. 3 in which the inlet opening 26 faces downwardly, the liquid or water confined between the turned-in parts 16 and 18 of the inlet channel is expelled as indicated by an arrow 40. In consequence of the expelling of liquid or water, a relative pressure drop is generated due to a venturi effect within the constriction defined between the circular reinforcing joints 30 as the inlet channel expands from the constriction towards the inlet opening 26 and as the second or inner segment of the inlet channel defined by the mutually convergent joints 32 constitutes a sort of reservoir from which liquid or water without hindering may flow towards the inlet opening of the inlet channel, i.e. without any substantial reduction of the flow rate of the liquid or channel so as to generate a maximum flow rate through the constriction defined between the circular reinforcing joints 30 of the liquid flowing downwardly from the second segment of the inlet channel due to the gravitational force. By the generation of the relative pressure drop caused by the venturi effect within the constriction between the circular reinforcing joints 30, a force impact on the turned-in parts 16 and 18 of the sheets 12 and 14 is generated, which force impact is illustrated in FIG. 3 by arrows 42. In response to the force impact, the turned-in parts 16 and 18 of the sheets 12 and 14 are caused to collapse and consequently pressed against one another so as to close the inlet channel defined between the turned-in parts 16 and 18 of the sheets 12 and 14 at the constriction, whereupon the liquid or water flowing from the interior of the freezing mould bag 10, more precisely flowing from the second segment of the inlet channel, flows into the closure pockets defined between the foils 12 and 14 and the corresponding turned-in parts 16 and 18, respectively, thereof, generating a complete filling out of the closure pockets. By filling out the closure pockets, the closure pockets are distended, resulting in that the turned-in parts 16 and 18 defining the closure valve flaps are further pressed against one another creating a permanent closing of the freezing mould bag 10.

The permanent closing of the freezing mould bag is further capable of maintaining the freezing mould bag hermetically sealed in case the freezing mould bag is shifted from its position shown in FIG. 3 to a position arranged in a substantially plane orientation on a supporting surface, e.g. a supporting surface of a deep-freezer or a home freezer in order to guarantee that the amount of liquid or water confined within the interior of the freezing mould bag 10 does not to any substantial extent leak from the interior of the freezing mould bag 10 during the freezing of the liquid or water. After the freezing of the liquid or water confined within the mould compartments 24 of the freezing mould bag 10, the freezing mould bag 10 and the ice lumps or ice cubes may be removed from the deep-freezer or the home freezer, and the ice lumps or ice cubes confined within the interior of the freezing mould bag 10 are easily removed from the freezing mould bag 10 by simple tearing apart or cutting the sheets 12 and 14 of the freezing mould bag 10.

The freezing mould bag 10 is preferably made from sheets of plastics foil material which are cut from a continuous plastic foil path as the above described joints 20,22,28,30 and 32 are preferably made by heat-welding the sheet materials together. Alternatively, the joints may be established by glueing the sheets and the turned-in parts thereof togther. It is to be noticed that the sheets 12 and 14 may be provided with printings corresponding to the mould compartments 24 of the freezing mould bag 10 in order to increase the volume of the ice lump or ice cube which is produced by the amount of liquid or water confined within the mould compartment 24.

Although the freezing mould bag 10 is preferably adapted and intended to be used for freezing water for generating ice lumps or ice cubes, the freezing mould bag 10 in itself, or a modified embodiment of the freezing mould bag, may be used for freezing other materials such as foodstuffs or the like which are frozen in individual minor portions.

Figure 4:
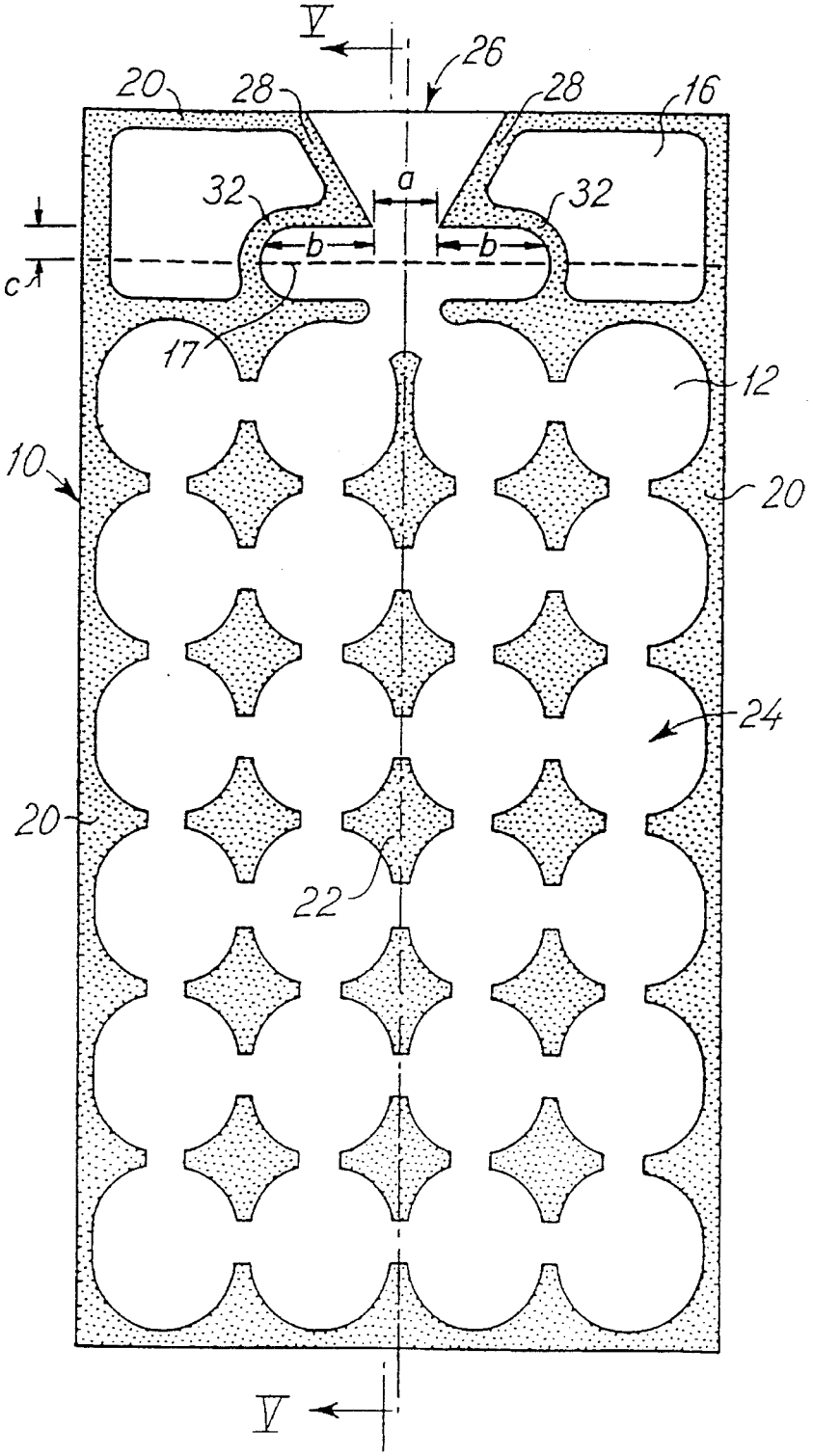
FIG. 4 is a schematical view of a second embodiment of a freezing mould bag according to the present invention.
Figure 5:
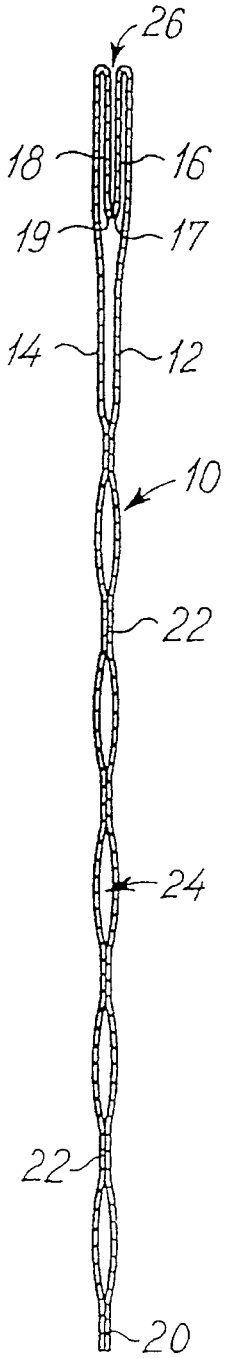
FIG. 5 is a sectional view of the second embodiment of a freezing mould bag shown in FIG. 4 as viewed along the sectional line V—V.

In FIGS. 4 and 5, a schematical and plane view and a vertical sectional view, respectively, of a second embodiment of the freezing mould bag according to the present invention are shown. The second embodiment basically differs from the above described, presently preferred, first embodiment shown in FIGS. 1–3 in that the circular reinforcing joints 30 are omitted and in that the joints 28 defining the first segment of the inlet channel are constituted by linear joints.

In FIG. 4, the reference a indicates the width of the constriction at the conjunction or the transition between the first segment and the second segment of the inlet channel. The reference b designates the distance from the outermost end of one of the joints 28, i.e. the outermost point of the constriction and the innermost end of the second segment in the direction perpendicular to the longitudinal direction of the inlet channel. The reference c designates the distance between the constriction at the width a and the edges 17 and 19 of the turned-in parts 16 and 18, respectively, of the sheets 12 and 14, respectively. The dimensions or distances a, b, and c preferably fulfil the following requirements. The distance b is preferably at least 0.3 times the distance a, further preferably 0.5–3.0 times the distance a, further preferably 0.7–2.0 times the distance a, such as 0.8–1.2 times the distance a. The distance c is preferably at least 0.5 times the distance a, further preferably 0.5–2.0 times the distance a.

Example

A prototype implementation of the presently preferred embodiment of the freezing mould bag according to the present invention shown in FIG. 1 was made from two sheets of 25 μm thick LD polyethylene. Each of the 25 μm thick LD polyethylene sheets 12 and 14 had a width of 18 cm and an overall length of 38.5 cm, as each of the turned-in parts 16 and 18 constituted a turned-in part of a length of 4.5 cm of each of the sheets 12 or 14 of total lengths of 38.5 cm. The length of the freezing mould bag 10 was, consequently, 34 cm. The 24 mould compartments 24 each had a width of 4 cm and a length of 4.5 cm, as the opening between any two adjacent mould compartments was 1 cm. The inlet opening 26 of the inlet channel had a width of 9 cm, and the length of the inlet channel from the inlet opening 26 to the constriction defined between the circular reinforcing joints 30, more precisely to the centres of the circular reinforcing joints 30, was 3.5 cm. The free distance within the constriction defined between the circular reinforcing joints 30 was 18 mm. The maximum width of the second segment of the inlet channel was 7.5 cm, and the length of the second segment of the inlet channel, i.e. the dimension of the second segment of the inlet channel in the longitudinal direction of the inlet channel was 2 cm. The overall length of the inlet channel was, consequently, 5.5 cm, and the edges 17 and 19 of the turned-in parts 16 and 18 defining the closure valve flaps were arranged at a distance of 4.5 cm from the inlet opening. The edges 17 and 19, consequently, were arranged at the centre of the second segment of the inlet channel.

Experiments were made revealing that the freezing mould bag implemented in accordance with the presently preferred embodiment of the freezing mould bag according to the present invention was functioning correctly, as the freezing mould bag was used in accordance with its intentional application, i.e. the freezing mould bag was filled with water as shown in FIG. 2, whereupon the freezing mould bag was turned upside down from its position shown in FIG. 2 to its position shown in FIG. 3, an amount of water was discharged from the freezing mould bag, which amount was substantially identical to the amount of water confined between the closure valve flaps defined by the turned-in parts 16 and 18, i.e. the excess amount of water present between the turned-in parts 16 and 18 of the sheets 12 and 14 after a complete filling of the interior of the freezing mould bag.

The experiments revealed that the prototype implemented in accordance with the presently preferred embodiment of the freezing mould bag according to the present invention provides a safe and reliable self-closing of the interior of the freezing mould bag in accordance with the venturi effect, characteristic of the present invention, generated within the constriction of the inlet channel prior to a complete filling of the cavities defined between the sheets 12 and 14 and the turned-in parts 16 and 18, respectively, thereof, defining closure valve flaps providing the permanent closing or sealing of the interior of the freezing mould bag relative to the environment.

We claim:

1. A freezing mould bag comprising:

two sheets of a foil material, said sheets being of substantially identical geometrical shape and defining an outer periphery, a peripheral joint extending along the majority of said outer periphery of said sheets, except for a peripheral area constituting an inlet opening of said bag, said peripheral joint joining said sheets together in substantially overlapping relationship and defining an inner space within the interior of said bag, said inner space constituting at least one mould compartment, an inlet channel defined by separate joints of said sheets and extending from said inner space of said bag to said inlet opening so as to provide access from the environment to said inner space of said bag through said inlet channel, two closure valve flaps connected to said sheets at said inlet opening and extending from said inlet opening within the interior of said bag towards said inner space of said bag along said inlet channel, said closure valve flaps being joined together and being joined to said sheets through said separate joints defining said inlet channel so as to provide two closure pockets being open towards said inner space of said bag, said inlet channel comprising a first segment and a second segment, said first segment being provided adjacent to said inlet opening, and said second segment interconnecting said first segment and said mould compartment, said first segment tapering towards said second segment, said first segment and said second segment defining at their transition a constriction, said inlet channel defining a first direction constituting the longitudinal direction of said inlet channel, and a second direction perpendicular to said first direction, said closure valve flaps extending from said inlet opening beyond said constriction at said transition, said second segment comprising a chamber defined by joints adjacent to said constriction diverging substantially along said second direction, linked by side joints to further joints being adjacent to said mould compartment, said further joints converging along said second direction to at least one passage into the inner space of said bag, said second segment having a maximum dimension of at least two times the dimension of said constriction, providing a liquid or water reservoir, from which liquid or water without hindering may flow towards the inlet opening through said constriction after the freezing mould bag has been filled with liquid or water through said inlet opening in a first position, in which said inlet opening faces upwardly, and after the freezing mould bag has been turned to a second position, in which said inlet opening faces downwardly, and said constriction at said transition providing a venturi effect for generating a pressure drop at said constriction for closing said inlet channel at said constriction as liquid is flowing from said second segment towards said first segment through said constriction so as to generate a self-closing effect.

2. A freezing mould bag according to claim 1, said closure valve flaps being constituted by turned-in parts of said sheets.

3. The freezing mould bag according to claim 1, said closure valve flaps extending to a position approximately at the center of said second segment.

4. The freezing mould bag according to claim 1, said closure valve flaps extending to a position adjacent to said constriction.

5. The freezing mould bag according to claim 1, said closure valve flaps extending substantially along the entire inlet channel.

6. The freezing mould bag according to claim 1, said closure valve flaps extending to a position defining a distance from said constriction being at least 0.5 times the dimension of said constriction.

7. The freezing mould bag according to claim 6, said distance being in the range from 0.5 to 2 times the dimensions of said constriction.

8. The freezing mould bag according to claim 1, said maximum dimension of said second segment along said second direction of said inlet channel being is the range from 2 to 7 times the dimension of said constriction.

9. The freezing mould bag according to claim 8, said maximum dimension of said second segment along said second direction of said inlet channel being in the range from 2.4 to 5 times the dimension of said constriction.

10. The freezing mould bag according to claim 8, said maximum dimension of said second segment along said second direction of said inlet channel being in the range from 2.6 to 3.4 times the dimension of said constriction.

11. The freezing mould bag according to claim 1, said first segment having a dimension along said second direction along said inlet channel at said inlet opening being approximately two times the dimensions of said constriction along said second direction.

12. The freezing mould bag according to claim 1, said first segment being defined by joints constituting straight lines or curved lines.

13. The freezing mould bag according to claim 1, said first segment being of a convex or concave configuration.

14. The freezing mould bag according to claim 1, said second segment being bounded by joints constituting straight lines or curved lines.

15. The freezing mould bag according to claim 14, said curved lines constituting segments of circles and said second segment being of a convex or concave configuration.

16. The freezing mould bag according to claim 1, said inlet channel being substantially symmetrical relative to its longitudinal axis.

17. The freezing mould bag according to claim 1, said sheets constituting segments of planar foil parts provided with printings corresponding to said mould compartments.

18. The freezing mould bag according to claim 1, said sheets constituting segments of foil parts provided with printings corresponding to said mould compartments.

19. The freezing mould bag according to claim 1, said sheets being plastic foil sheets.

20. The freezing mould bag according to claim 1, said sheets being aluminum foil sheets.

21. The freezing mould bag according to claim 1, said joints being constituted by welded joints.

22. The freezing mould bag according to claim 1, said joints being constituted by glued joints.

23. A freezing mould bag comprising:

two sheets of a foil material, said sheets being of substantially identical geometrical shape and defining an outer periphery, a peripheral joint extending along the majority of said outer periphery of said sheets, except for a peripheral area constituting an inlet opening of said bag, said peripheral joint joining said sheets together in substantially overlapping relationship and defining an inner space within the interior of said bag, said inner space constituting at least one mould compartment, an inlet channel defined by separate joints of said sheets and extending from said inner space of said bag to said inlet opening so as to provide access from the environment to said inner space of said bag through said inlet channel, two closure valve flaps connected to said sheets at said inlet opening and extending from said inlet opening within the interior of said bag towards said inner space of said bag along said inlet channel, said closure valve flaps being constituted by turned-in parts of said sheets and joined together and being joined to said sheets through said separate joints defining said inlet channel so as to provide two closure pockets being open towards said inner space of said bag, said inlet channel comprising a first segment and a second segment, said first segment being provided adjacent to said inlet opening, and said second segment interconnecting said first segment and said mould compartment, said first segment tapering towards said second segment, said first segment and said second segment defining at their transition a constriction, said inlet channel defining a first direction constituting the longitudinal direction of said inlet channel, and a second direction perpendicular to said first direction, said closure valve flaps extending from said inlet opening beyond said constriction at said transition, said second segment comprising a chamber defined by joints adjacent to said constriction diverging substantially along said second direction, linked by side joints to further joints being adjacent to said mould compartment, said further joints converging along said second direction to at least one passage into the inner space of said bag, said second segment having a maximum dimension of at least two times the dimension of said constriction, providing a liquid or water reservoir, from which liquid or water without hindering may flow towards the inlet opening through said constriction after the freezing mould bag has been filled with liquid or water through said inlet opening in a first position, in which said inlet opening faces upwardly, and after the freezing mould bag has been turned to a second position, in which said inlet opening faces downwardly, and said constriction at said transition providing a venturi effect for generating a pressure drop at said constriction for closing said inlet channel at said constriction as liquid is flowing from said second segment towards said first segment through said constriction so as to generate a self-closing effect.

24. A freezing mould bag comprising:

two sheets of a foil material, said sheets being of substantially identical geometrical shape and defining an outer periphery, a peripheral joint extending along the majority of said outer periphery of said sheets, except for a peripheral area constituting an inlet opening of said bag, said peripheral joint joining said sheets together in substantially overlapping relationship and defining an inner space within the interior of said bag, said inner space constituting a plurality of mould compartments being interconnected and being defined by additional joints of said sheets, an inlet channel defined by separate joints of said sheets and extending from said inner space of said bag to said inlet opening so as to provide access from the environment to said inner space of said bag through said inlet channel, two closure valve flaps connected to said sheets at said inlet opening and extending from said inlet opening within the interior of said bag towards said inner space of said bag along said inlet channel, said closure valve flaps being joined together and being joined to said sheets through said separate joints defining said inlet channel so as to provide two closure pockets being open towards said inner space of said bag, said inlet channel comprising a first segment and a second segment, said first segment being provided adjacent to said inlet opening, and said second segment interconnecting said first segment and said mould compartments, said first segment tapering towards said second segment, said first segment and said second segment defining at their transition a constriction, said inlet channel defining a first direction constituting the longitudinal direction of said inlet channel, and a second direction perpendicular to said first direction, and said closure valve flaps extending from said inlet opening beyond said constriction at said transition, said second segment comprising a chamber defined by joints adjacent to said constriction diverging substantially along said second direction, linked by side joints to further joints being adjacent to said or mould compartments, said further joints converging along said second direction to at least one passage into the inner space of said bag, said second segment having a maximum dimension of at least two times the dimension of said constriction, providing a liquid or water reservoir, from which liquid or water without hindering may flow towards the inlet opening through said constriction after the freezing mould bag has been filled with liquid or water through said inlet opening in a first position, in which said inlet opening faces upwardly, and after the freezing mould bag has been turned to a second position, in which said inlet opening faces downwardly, and said constriction at said transition providing a venturi effect for generating a pressure drop at said constriction for closing said inlet channel at said constriction as liquid is flowing from said second segment towards said first segment through said constriction so as to generate a self-closing effect.

25. The freezing mould bag according to claim 24, said second segment having a size in the range from approximately 1 to 2 times the size of a single mould compartment.

26. The freezing mould bag according to claim 24, said closure valve flaps extending to a position approximately at the center of said second segment.

27. The freezing mould bag according to claim 24, said closure valve flaps extending to a position adjacent to said constriction.

28. The freezing mould bag according to claim 24, said closure valve flaps extending substantially along the entire inlet channel.

29. The freezing mould bag according to claim 24, said closure valve flaps extending to a position defining a distance from said constriction being at least 0.5 times the dimension of said constriction.

30. The freezing mould bag according to claim 29, said distance in the range from 0.5 to 2 times the dimensions of said constriction.

31. The freezing mould bag according to claim 24, said maximum dimension of said second segment along said second direction of said inlet channel being in the range from 2 to 7 times the dimension of said constriction.

32. The freezing mould bag according to claim 31, said maximum dimension of said second segment along said second direction of said inlet channel being in the range from 2.4 to 5 times the dimension of said constriction.

33. The freezing mould bag according to claim 31, said maximum dimension of said second segment along said second direction of said inlet channel being in the range from 2.6 to 3.4 times the dimension of said constriction.

34. The freezing mould bag according to claim 24, said first segment having a dimension along said second direction along said inlet channel at said inlet opening being approximately two times the dimensions of said constriction along said second direction.

35. The freezing mould bag according to claim 24, said first segment being defined by joints constituting straight lines or curved lines.

36. The freezing mould bag according to claim 24, said first segment being of a convex or concave configuration.

37. The freezing mould bag according to claim 24, said second segment being bounded by joints constituting straight lines or curved lines.

38. The freezing mould bag according to claim 37, said curved lines constituting segments of circles and said second segment being of a convex or concave configuration.

39. The freezing mould bag according to claim 24, said inlet channel being substantially symmetrical relative to its longitudinal axis.

40. The freezing mould bag according to claim 24, said sheets constituting segments of planar foil pans provided with printings corresponding to said mould compartments.

41. The freezing mould bag according to claim 24, said sheets constituting segments of foil parts provided with printings corresponding to said mould compartments.

42. The freezing mould bag according to claim 24, said sheets being plastic foil sheets.

43. The freezing mould bag according to claim 24, said sheets being aluminum foil sheets.

44. The freezing mould bag according to claim 24, said joints being constituted by welded joints.

45. The freezing mould bag according to claim 24, said Joints being constituted by glued joints.

* * * * *